United States Patent [19]

Smyth

[11] 4,112,749

[45] Sep. 12, 1978

[54] WRENCHES AND OTHER HAND TOOLS

[75] Inventor: Norman Linfoot Smyth, Sheffield, England

[73] Assignee: Britool Limited, West Midlands, England

[21] Appl. No.: 757,569

[22] Filed: Jan. 7, 1977

[30] Foreign Application Priority Data

Jan. 14, 1976 [GB] United Kingdom ..... 1294/76

[51] Int. Cl.[2] ..... B25B 23/142

[52] U.S. Cl. ..... 73/139; 81/52.5

[58] Field of Search ..... 73/139; 81/52.4 R, 52.5

[56] References Cited

U.S. PATENT DOCUMENTS 2,786,378 3/1957 Ethington et al. ..... 81/52.4 R 3,546,933 12/1970 Crabovac ..... 73/139 X

*Primary Examiner*—Charles A. Ruehl

*Attorney, Agent, or Firm*—Norris & Bateman

[57] ABSTRACT

A torque unit for use as an accessory to a conventional socket spanner or other wrench-type tool has a body which can be mounted at a selected position along the tool handle and a member movable relative to the body through which a turning moment is applied by the user, the unit including resilient means, preferably adjustable, biasing said member in opposition to the turning moment and warning means giving a signal sensed by the user, conveniently a sudden displacment and noise, when the load transmitted by the resilient means exceeds a predetermined level in use, of which the following is a specification.

8 Claims, 4 Drawing Figures

WRENCHES AND OTHER HAND TOOLS

This invention relates to ring or socket wrenches, spanners, and other hand tools of the kind in which a turning moment is applied to a nut, bolt, screw or other threaded workpiece by means of a lever handle and the term "wrench" is used hereinafter to include all hand tools of this kind. In assembling threaded workpieces it is important that recommended torque levels are reached to ensure adequate tightness, but not exceeded so as to cause excess stress and possibility of failure, and many types of wrenches having built-in torque limiting or indicating means have been designed for this purpose. Such wrenches are expensive, as compared with ordinary general purpose wrenches, and may not be particularly convenient in use due to size and weight. There is also the possibility of wear and damage to torque mechanism if a torque wrench is used for general purposes where the torque-setting facility is unnecessary.

The object of the present invention is to increase the adaptability of existing general-purpose wrenches by enabling them to be readily adapted to operate as torque wrenches as and when required.

According to the invention there is provided a torque unit for use on a lever handle of a wrench, characterised in that the unit comprises a first member adapted to be mounted on the handle, a second member movable relative to the first member and through which a turning moment is applied to the handle by a user in use, resilient means biasing the second member in opposition to said turning moment, and warning means giving a signal to be sensed by the user when the load transmitted by the resilient means exceeds a predetermined level in use.

Preferred embodiments of the invention are now more particularly described with reference to the accompanying drawings, wherein.

Figure 1:
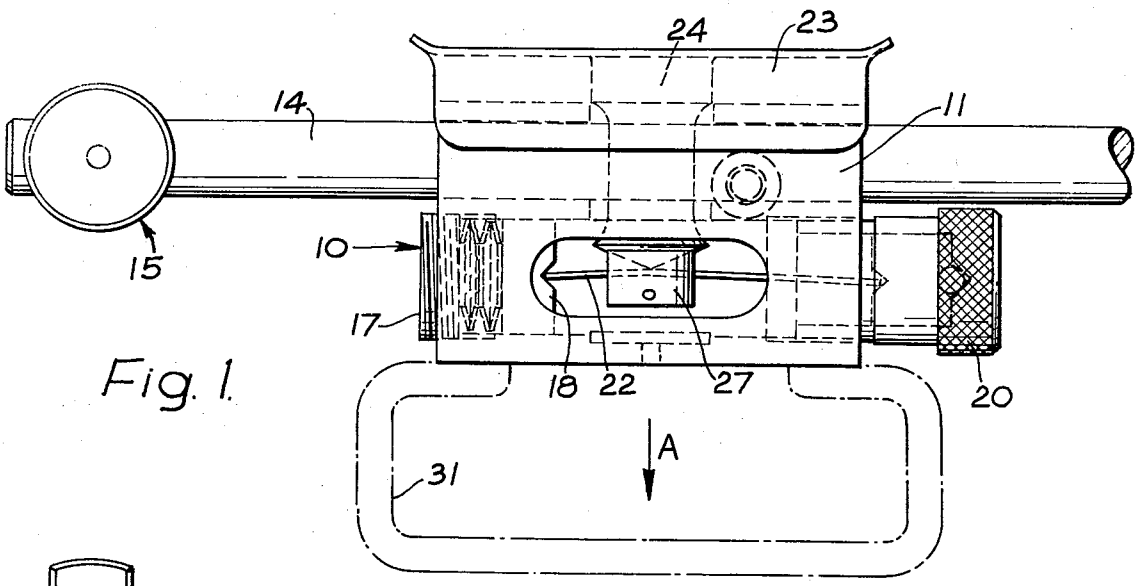
FIG. 1 is a plan view of a torque unit mounted on a wrench.
Figure 2:
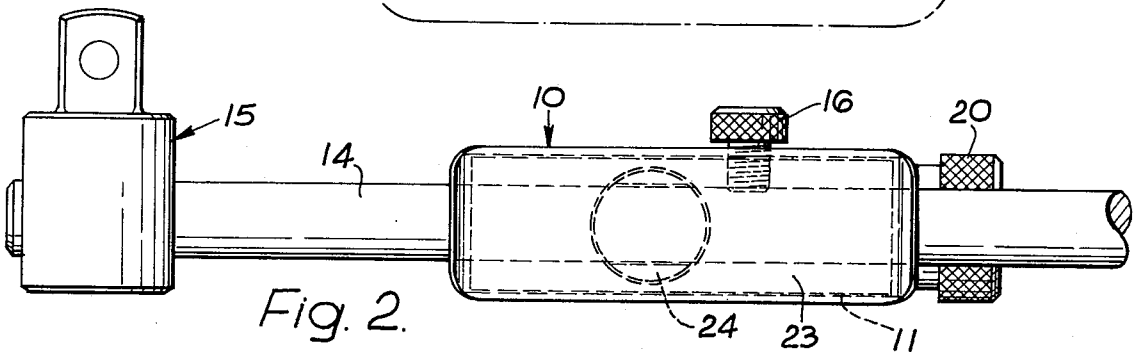
FIG. 2 is a side view of said mounted unit.
Figure 3:
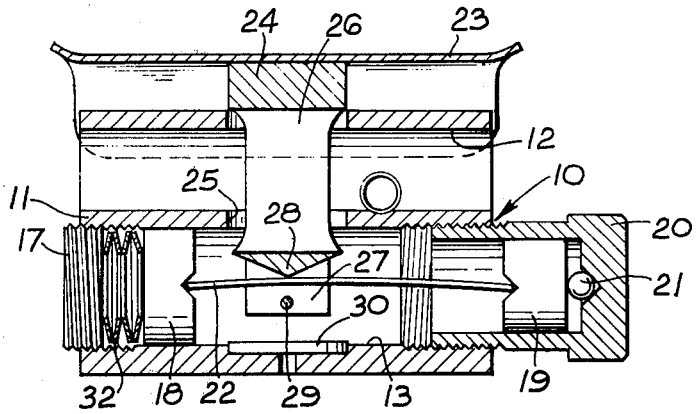
FIG. 3 is a longitudinal section of the unit.

Referring firstly to FIGS. 1 to 3, a torque unit 10 comprises a first member in the form of a body 11 having a pair of parallel longitudinal bores 12, 13 (FIG. 3), bore 12 being a sliding fit on handle 14 of a socket wrench 15, and being releasably secured at any selected position therealong by a clamping screw 16 (FIG. 2).

Bore 13 has a screwed plug 17 (FIG. 3) at one end, against the inner face of which acts a first pressure pad 18 having a transverse groove across its inner face. A second pressure pad 19, also grooved, is received within a cup-shaped adjusting screw 20 in threaded engagement with the other end of bore 13. A ballbearing 21 is located in a recess in the end wall of screw 20 to serve as a thrust bearing so that the screw can be freely rotated relative to pad 19. A leaf spring 22 has its ends located in the notches of pads 18 and 19 so that it extends longitudinally within bore 13.

A second member comprises a handpiece 23 of channel section which embraces one side of body 11 and is carried on a plunger 24 located in a transverse bore 25 which is intersected by bore 12 and extends into bore 13. Plunger 24 is of greater diameter than bore 12 and has an elongated aperture 26 giving clearance for handle 14, thus the second member is freely moveable laterally of the first member.

The inner end of plunger 24 is forked to embrace spring 22. Between legs 27 of the fork, plunger 24 is profiled at an angle (or fitted with a cross pin) to provide transverse line contact at 28 with the abutting face of spring 22 while a cross pin 29 is positioned adjacent the opposite face.

Spring 22 is given a permanent set so that it is "preferentially" bowed toward plunger 24 and the amount of bowing can be adjusted by means of screw plug 17 and adjusting screw 20. Screw plug 17 will normally be adjusted only during manufacture to calibrate the unit. Adjusting screw 20 is provided with a calibrated scale (not shown) in units of force and will be set by the user according to the desired torque level for the particular application, calculated in relation to the longitudinal position of unit 10 on the wrench handle 14. By moving unit 10 along handle 14 and also adjusting the screw 20 a wide range of torque settings may be provided without needing an extensive range of adjustment to the built into the unit itself.

The user will apply torque to a nut, screw or other workpiece by pulling on the handpiece 23 against the biasing of spring 22 i.e. in the direction of arrow A in FIG. 1. When the predetermined torque level is reached spring 22 will snap over-centre so that plunger 24 suddenly moves inwards to strike a metal pad 30 in bore 13, giving as a signal an audible click. Additionally this sudden relative movement can also be felt and seen by the user.

Unit 10 can be removed from wrench 15 when not required and may be provided with clips, clamps or other forms of mounting means enabling it to be used in combination with other types of wrenches, for example ring or open-ended spanners.

In a modified form of the above unit a pull handle 31 (shown in broken lines in FIG. 1) linked to plunger 24 projects to the side of body 11 remote from wrench handle 14. In this case the user will grip the pull handle 31 and his hand will not embrace the body 11, so avoiding the possibility of false readings due to handpiece 23 and body 3 being gripped and squeezed together in the hand while the wrench is being used.

A stack of Belleville washers 32 is shown between screwed plug 17 and pressure pad 18. These are arranged according to the desired working range, to act in conjunction with spring 22, but in some constructions they may be omitted so that pad 18 bears directly on plug 17, or other types of compression spring could be used.

Figure 4:
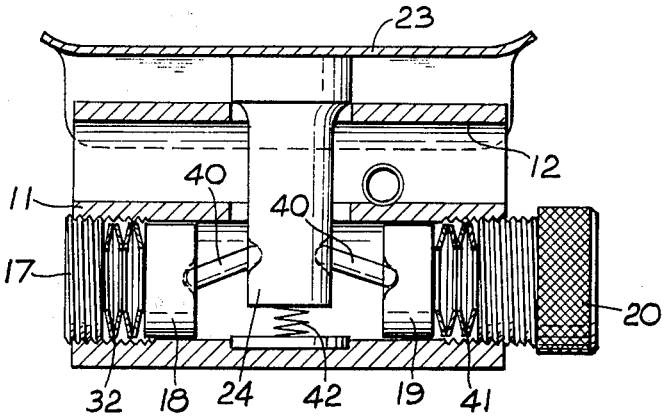
FIG. 4 is a like section of a modified form of the unit.

In the modified construction shown in FIG. 4, leaf spring 22 is replaced by a pair of rigid push rods 40 supported at an angle in knuckle joints in the inner end of plunger 24 and in pressure pads 18 and 19 with Belleville washers 32, 41 or other resilient means acting on both said pads. A return spring 42 is incorporated to restore plunger 24 to its initial position when pressure is removed from it.

The lever handle 14 of a socket wrench or similar tool may be calibrated in units of length for use with the device, and the latter may bear a table of torque settings calculated as the function of the position of the device along the handle and the calibration of adjusting screw 20.

A pull handle as at 31 can be attached directly to plunger 24 by a shaft (not shown) passing through an aperture in body 11 and pad 30.

In the case of a double ended open spanner the device may be connected by means of a loop passing round body 11 and clearing handpiece 23 so that it can be hooked onto the open end of the spanner remote from the nut, bolt etc.

Having now described my invention what I claim is:

1. A torque unit for use on a lever handle of a wrench or the like including a body member provided with releasable clamping means for rigid attachment thereof to said handle so as to maintain said member at a selected distance along said handle from the axis of rotation of an element to be engaged and turned by the wrench in use and in predetermined relationship to the plane in which said handle moves about said axis in use; a second member operatively connected to said body member and guided for rectilinear movement relative to the body member substantially in said plane in a direction normal to said lever handle through which member a turning moment is applied to said handle by a user in use; resilient means exerting force biasing the second member in opposition to said turning moment; and warning means actuated by displacement of said second member in opposition to said force when the load transmitted by the resilient means exceeds a predetermined level for giving a signal to be sensed by the user; said resilient means comprising a leaf spring adapted to be intermediately engaged by said second member bowed so that it snaps over centre under predetermined lateral pressure applied by the second member, and said spring also comprising part of said warning means.

2. A unit as claimed in claim 1 including means for selectively adjusting the biasing force exerted by said resilient means.

3. A unit as claimed in claim 1 wherein said second member comprises a plunger movable in a transverse body bore guiding it for said rectilinear movement.

4. A unit as claimed in claim 3 wherein said second member comprises a handpiece mounted on an outer end of said plunger.

5. A unit as claimed in claim 3 wherein said second member comprises a pull handle linked to said plunger.

6. A unit as claimed in claim 1 characterized in that said warning means further comprises a formation on said body member which is contacted by said second member when said snapping-over occurs.

7. A torque unit for use on a lever handle of a wrench or the like including a body member provided with releasable clamping means for rigid attachment thereof to said handle so as to maintain said member at a selected distance along said handle from the axis of rotation of an element to be engaged and turned by the wrench in use and in predetermined relationship to the plane in which said handle moves about said axis in use; a second member operatively connected to said body member and guided for rectilinear movement relative to the body member substantially in said plane in a direction normal to said lever handle through which member a turning moment is applied to said handle by a user in use, said second member comprising a plunger movable in a transverse body bore guiding it for said rectilinear movement; resilient means exerting force biasing said plunger in opposition to said turning moment, said plunger acting through a pair of angled rigid push rods connected to opposing pressure pads, and said resilient means biasing said pads towards each other and the plunger; and warning means actuated by displacement of said plunger in opposition to said force when the load transmitted by the resilient means exceeds a predetermined level for giving a signal to be sensed by the user.

8. A unit as claimed in claim 7, wherein said resilient means comprises stacks of Belleville washers backing the respective pressure pads.

* * * * *